US008294384B2

(12) United States Patent
Matsuda

(10) Patent No.: US 8,294,384 B2
(45) Date of Patent: Oct. 23, 2012

(54) DIMMING ELECTRONIC BALLAST WITH PREHEAT CURRENT CONTROL

(75) Inventor: Kenji Matsuda, Hirakata (JP)

(73) Assignee: Panasonic Corporation, Osaka (JP)

( * ) Notice: Subject to any disclaimer, the term of this patent is extended or adjusted under 35 U.S.C. 154(b) by 544 days.

(21) Appl. No.: 12/547,072

(22) Filed: Aug. 25, 2009

(65) Prior Publication Data

US 2010/0109548 A1 May 6, 2010

(30) Foreign Application Priority Data

Aug. 25, 2008 (JP) ..... 2008-215809

(51) Int. Cl.
*H05B 41/16* (2006.01)

(52) U.S. Cl. ..... 315/279; 315/209 R; 315/291

(58) Field of Classification Search ..... 315/200 R, 315/209 R, 219, 224, 246, 268, 276, 279, 315/283, 287, 291, 302, 307–308
See application file for complete search history.

(56) References Cited

U.S. PATENT DOCUMENTS 5,170,099 A * 12/1992 Ueoka et al. ..... 315/291
5,502,423 A * 3/1996 Okude et al. ..... 315/291
5,644,480 A * 7/1997 Sako et al. ..... 363/17
5,920,155 A * 7/1999 Kanda et al. ..... 315/307
6,054,815 A * 4/2000 Sugita et al. ..... 315/244
6,057,652 A * 5/2000 Chen et al. ..... 315/307
6,636,005 B2 * 10/2003 Wacyk et al. ..... 315/291
6,828,740 B2 * 12/2004 Takahashi et al. ..... 315/291
6,963,176 B2 * 11/2005 Onishi et al. ..... 315/291
2007/0296355 A1 * 12/2007 Hamamoto et al. ..... 315/309

FOREIGN PATENT DOCUMENTS

JP 2002231483 8/2002
JP 20050019142 1/2005
JP 2006188641 7/2006

* cited by examiner

*Primary Examiner* — Jason M Crawford
(74) *Attorney, Agent, or Firm* — Waddey & Patterson, P.C.; Mark J. Patterson; Gary L. Montle

(57) ABSTRACT

An electronic ballast is capable of realizing high frequency lighting of a discharge lamp and switching between at least two lighting modes with different light outputs. The ballast includes a preheating circuit having a winding component connected in parallel with a main resonant circuit with a lamp current flowing therein for the discharge lamp. A constant preheating current for the lamp filaments is supplied from a secondary winding of the winding component during lighting of the discharge lamp and a path of a current flowing on a primary winding side of the winding component is switched by a switch according to the lighting mode.

20 Claims, 10 Drawing Sheets

DIMMING ELECTRONIC BALLAST WITH PREHEAT CURRENT CONTROL

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

CROSS-REFERENCES TO RELATED APPLICATIONS

This application claims benefit of the following patent application(s) which is hereby incorporated by reference: Japanese Patent Application No. JP2008-215809, filed Aug. 25, 2008.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present invention relates to an electronic ballast for a discharge lamp having at least two lighting modes with different light outputs, and a lighting fixture using such ballast.

In a discharge lamp of a thermionic cathode type such as a fluorescent lamp, lamp illumination performance and a lamp life can be secured by maintaining an appropriate filament temperature in the lamp. FIG. 9 shows an example of typical lamp dimming control data defined according to the IEC. The horizontal axis employs numerical values obtained by dividing a lamp current Id by a reference current Itest. The vertical axis employs numerical values obtained by dividing the sum of squares of a large current side $I_{LH}$ and a small current side $I_{LL}$ of a lead wire current by the square of the reference current Itest, wherein a maximum dimming control curve A, a target dimming control curve B and a minimum dimming control curve C are defined. More specifically, a maximum target value, a recommended target value and a minimum target value are shown for a current Id flowing into the lamp filaments for each dimming level.

In the present specification, a lead wire current obtained during illumination is divided into a current referred to as a lead wire current which includes a lamp current (i.e. large current side), and a current referred to as a constant preheating current which flows via filaments (i.e. small current side). Indexes employed in the vertical axis in FIG. 9 are obtained by dividing the sum of squares of the lead wire current and the constant preheating current by the square of the lamp current, and can be said as indicating the conditions of a constant preheating current required for each lamp current.

A curve D in FIG. 9 (without any flow of a constant preheating current) is provided with numerical values plotted on an assumption that a lead wire current is equal to a lamp current and a constant preheating current is 0 [A]. If a lamp current which is substantially equal to a rating of a discharge lamp is made to flow (refer to an area in the vicinity of 1.0 in the lateral axis), the curve D substantially overlaps a target dimming control curve but shows indexes which decrease in accordance with reduction of a lighting output and fall under the lower target value in course of time (refer to an area less than 0.7 in the lateral axis).

That is, it can be said that a filament temperature suitable for illumination can be maintained in the vicinity of rated illumination of a discharge lamp by constantly preheating filaments using the lamp current. Dimming control, on the other hand, requires a larger constant preheating current to maintain the appropriate filament temperature in accordance with a lower lamp output.

As stated above, it is a well-know fact that a required amount of the constant preheating current is increased when dimming the discharge lamp.

An operation in an electronic ballast for a discharge lamp will be explained referring to a first conventional example shown in FIGS. 10 and 11 with respect to the present invention to achieve an appropriate flow of a constant preheating current during illumination by corresponding to a lighting output in a ballast having at least two lighting modes with different light outputs.

FIG. 10 is a circuit configuration of the discharge lamp ballast according to the first conventional example. FIG. 11 is a graph showing characteristics of a resonance circuit made of an inductor L2 and a capacitor C3 in each control state of preheating, starting, rated lighting and dimmed lighting, and a relationship between a constant preheating current flowing into filaments at that time and a driving frequency in an inverter 12.

A low frequency AC power source sent from a commercial power source 10 is rectified by a diode bridge including diodes D1 to D4 in a step-up chopper circuit 11. The voltage is stepped up by a step-up chopper circuit including a choke coil L1, a transistor Q1 and a diode D5. Obtained at both ends of an electrolytic capacitor C2 is a DC voltage of, for example, about 300V. This DC voltage is converted into a high frequency current in inverter 12 and used as a lighting current for a discharge lamp 13.

The inverter 12 has a half bridge inverter circuit including a pair of transistors Q2 and Q3, and an inverter control circuit 14 drives the transistors Q2 and Q3 to be turned on/off alternately to output high frequency power. The high frequency power is supplied to the discharge lamp 13 via filaments by passing through a DC blocking capacitor C4 and the inductor L2.

A control power source circuit 15 which includes a step-down chopper circuit or similar circuit generates a DC low voltage (e.g. 12V) which is supplied to the inverter control circuit 14 and a chopper control circuit 16. The chopper control circuit 16 may include a control IC (e.g. MC33262 made by Motorola, Inc.) and generates a gate control signal for the transistor Q1 in the step-up chopper circuit 11. The inverter control circuit 14 provides each gate of the transistors Q2 and Q3 in the inverter 12 with a signal oscillated by using a versatile control IC (e.g. μPC494 made by NEC cooperation) via a driver circuit (e.g. IR2111 made by International Rectifier Corp.).

When power is applied, the chopper control circuit 16 and the inverter control circuit 14 starts oscillation to bring an output voltage Vdc in the step-up chopper circuit 11 to about 300V and an oscillation frequency in the inverter 12 to fp=95 kHz. At this time, a voltage obtained at the filaments of the discharge lamp 13 is lower than a lamp starting voltage, which means the discharge lamp 13 does not light.

High frequency power outputted from the inverter 12 is also made to flow into a transformer T2 through a capacitor C9. Power induced to a secondary side of the transformer T2 causes a current to flow into the filaments of the discharge lamp 1 through capacitors C7 and C8. This current obtained before the discharge lamp 13 starts is a required preheating current of, for example, about 700 mA.

Preheating is carried out for two to three seconds and is followed by reducing an oscillation frequency in the inverter 12 to fs=80 kHz. As a result, the voltage at the lamp filaments is increased to a required starting voltage, whereby the lamp illuminates. Thereafter, the oscillation frequency in the inverter circuit 12 is reduced to fr=55 kHz to bring the discharge lamp 13 into a rated lighting state.

In the case where lamp dimming is desired (luminance which is lower than rated luminance), a dimming control signal is sent to the inverter control circuit 14. Therefore, the oscillation frequency in the inverter circuit 12 is changed to fd=75 kHz for the discharge lamp 13 to be in a dimmed lighting state.

FIG. 11 graphically shows the frequency characteristics of a voltage V1*a* applied to the discharge lamp 13, including (a) resonance characteristic at no loading when the discharge lamp 13 is turned off, (b) resonance characteristic in dimmed lighting, and (c) resonance characteristic at rated lighting. Impedance in the discharge lamp 13 is added to the resonance circuit in during lighting, so that the Q of the resonance circuit is reduced with a lower resonance frequency and resonance voltage than those obtained at no loading. FIG. 11 also shows a frequency characteristic of a filament current.

As dimming control is deepened with an increased oscillation frequency in the inverter circuit 12, the filament current is increased as understood from the filament current curve in FIG. 11. This is because of a resonance action in a resonant circuit made of the capacitor C9 and an inductance in a primary winding of the transformer T2. This resonant frequency is higher than a resonant frequency in the inverter in each control state of preheating, starting, rated lighting and dimmed lighting, which suggests that a current flowing into the filaments is larger in accordance with a higher operating frequency in the inverter, or a lower lamp voltage before the start of discharging or a lower lighting output during lighting.

It is therefore made possible to appropriately secure a required preheating current before the lamp starts and a constant preheating current during dimming control.

An operation of an electronic ballast will also be explained by referring to a second conventional example in FIGS. 12 and 13, with respect to an invention to lower power consumption by carrying out an operation to secure a preheating current in a preheating period and to prevent a constant preheating current from flowing after stable lighting.

FIG. 12 shows a configuration of an electronic ballast according to a second conventional example, including an AC power source 10, a rectifier DB for rectifying an output of the AC power source 10, a DC power source circuit 11*a* for smoothing an output of the rectifier DB. An inverter 12 converts a DC voltage outputted from the DC power source circuit 11*a* into high frequency power. A preheating circuit 5 includes a series circuit having a capacitor C9 connected across the output of inverter 12, a primary winding N1 of a preheating transformer T2 and a preheating switching element SW1. A control circuit 4 controls the preheating switching element SW1 to be turned on/off and the inverter 12. A load circuit 6 is made of a series circuit including a DC-blocking capacitor C4 connected between output ends of the inverter 12, a resonant inductor L2, and a discharge lamp 13 of a thermionic cathode type, and a resonant capacitor C3 connected in parallel with the discharge lamp 13. The two preheating windings N21 and N22 arranged in the preheating transformer T2 are connected to filaments F1 and F2 in the discharge lamp 13 via capacitors C7 and C8 respectively.

The control circuit 4 which controls the inverter circuit 12 and the preheating circuit 5 carries out each control of filament preheating, starting and lighting for the discharge lamp 13 after the AC power source 10 is supplied to start the inverter 12. The control circuit 4 includes: a timer circuit 41 for setting each switching time to switch operations in the inverter 12 from a preheating state to a starting state, and from the starting state to a lighting state, and switching time to switch operations in the preheating circuit 5 from a preheating current supplying state to a preheating current stopping state respectively, and outputting a control signal corresponding to each switching time. A frequency setting circuit 42 sets each operating frequency in the inverter 12 in the preheating state, the starting state and the lighting state in accordance with each control signal outputted from the timer circuit 41. A driving circuit 43 outputs a driving signal to determine switching of the switching elements in the inverter 12 on the basis of a frequency set by the frequency setting circuit 42. An inverter 44 outputs a control signal δ obtained by inverting a control signal Y which is outputted from the timer circuit 41 to control preheating switching element SW1.

An operation of the control circuit 4 will be explained below by using a timing chart shown in FIG. 13. First, after time point t0 to start driving the control circuit 4, the discharge lamp 13 is brought into the preheating state (preheating mode). An amount of time t1 to maintain the preheating state is set by a control signal α outputted by the timer circuit 41, during which the inverter 12 is subjected to a switching operation at a frequency fp set for the preheating state.

Next, after passing the time t1, the control signal α is switched from "L" to "H" for switching to a starting state (i.e. starting mode) to apply a voltage required for starting to both ends of the discharge lamp 13. An amount of time t2 to maintain the starting state is set by a control signal β outputted by the timer circuit 41, during which the inverter 12 is subjected to a switching operation at a frequency fs (fs<fp) set for the starting state.

Next, after passing the time t2, the control signal β is switched from "L" to "H" for switching to a lighting state (i.e. lighting mode) to supply power required for rated lighting of the discharge lamp 13. At the time t2 and thereafter, the control signal α is set to "H" and the control signal β is set to "H", wherein the inverter circuit 12 is subjected to a switching operation at a frequency fr (fr<fs<fp) set for the lighting state at this time to realize lighting of the discharge lamp 13 by a predetermined output.

In the present conventional example, the control signal δ obtained by inverting the control signal Y which is switched from "L" to "H" at time t3 set as t1<t3<t2 is used to turn on the preheating switch element SW1 up to the time t3 so as to supply a preheating current, and the preheating switch element SW1 is turned off at the time t3 and thereafter to stop supplying a preheating current If.

More specifically, a preheating current is made to flow in filaments in the precedent preheating period and a constant preheating current supplied to the filaments is stopped after stable lighting. Therefore, power consumption by a constant preheating current which is unnecessary in normal lighting and adverse effects to a lamp life are prevented.

BRIEF SUMMARY OF THE INVENTION

In the electronic ballast described as the first conventional example, a lighting output and a constant preheating current are appropriately supplied as stated above by a combination of the two independent resonant circuits including a main resonant circuit for supplying lighting power and a preheating resonant circuit for supplying filament preheating power, and the interrelationship therebetween is largely affected by variations in the characteristics of components which constitute the resonant circuits, thereby making it difficult to design the circuits.

In designing the preheating resonant circuit so as to have relatively fewer effects from component variations, the design needs to be realized such that preheating power applied to filaments has fewer variations resulting from a frequency characteristic in an inverter operating range during lighting, and preheating power exhibits an output curve which is substantially flat relative to variations of lighting power. In this case, a current which makes little difference to a current in a dimming control state is made to flow into filaments even in a full-lighting mode in which a constant preheating current is unnecessary, causing concern about an increased power loss without contributing to a light output and adverse effects to a lamp life.

Meanwhile, in the electronic ballast described as the second conventional example, the constant preheating current is stopped after achieving stable lighting, thereby eliminating the concern considered as a problem in the first conventional example about power loss without contributing to a light output and adverse effects to the lamp life. However, this configuration will result in having an insufficient preheating current because no constant preheating current is supplied during dimming control, and there is another concern about adverse effects such as premature filament failure.

The present invention was achieved by taking the above problems into consideration, having an object to improve efficiency of an electronic ballast by cutting off an unnecessary constant preheating current in a full-lighting mode and thereby reducing power loss which does not contribute to a light output. The invention also prevent problems related to a short life of a discharge lamp such as premature filament failure by maintaining an appropriate filament temperature during lighting resulting from securing a constant preheating current in a dimming control mode with a reduced light output.

A first aspect of the present invention is characterized by an electronic ballast as shown in FIG. 1 which is capable of realizing high frequency lighting of a discharge lamp 13 and switching at least two lighting modes with different light outputs. The ballast includes a preheating circuit (including transformer T2 and capacitors C7, C8 and C9) having a winding component (i.e. T2) connected in parallel with a main resonant circuit (including inductor L2 and capacitor C3) with a lamp current flowing therein for the discharge lamp 13. A constant preheating current for filaments is supplied from a secondary winding of the winding component T2 during lighting of the discharge lamp 13 and a path of a current flowing on a primary winding side of the winding component T2 is switched by a switch Q4 according to a lighting mode.

A second aspect of the present invention is based on the electronic ballast according to a first aspect of the present invention, wherein the preheating circuit constitutes an LC resonant circuit including the primary winding of the winding component T2 and a serially connected capacitance C9. An oscillation frequency in the electronic ballast during lighting is operated to be higher than a resonant frequency in the first resonant circuit (including L2 and C3) with a lamp current flowing therein, and lower than a resonant frequency in a preheating resonant circuit (including T2 and C9).

A third aspect of the present invention is based on the electronic ballast according to the first or second aspect of the present embodiment, having a first lighting mode (i.e. full-lighting mode) and a second lighting mode (i.e. dimming control mode) allowing an operation over a plurality of stages with a light output less than that of the first lighting mode as shown in FIGS. 5 and 6. The first lighting mode (i.e. full-lighting mode) turns off the switch Q4 arranged in the current path so as to stop or reduce a constant filament preheating current during lighting. The second lighting mode (i.e. dimming control mode) turns on the switch Q4 arranged in the current path so as to supply a constant preheating current to the filaments during lighting.

A fourth aspect of the present invention is based on the electronic ballast according to any one of the first to third aspects and makes it possible to realize a light output control over a plurality of stages with a visually continuous dimming operation. The amount of a preheating current is controlled in accordance with a lighting mode by changing the switch Q4 to operate corresponding to a lighting control signal or a signal secondarily generated from the lighting control signal as shown in FIG. 7.

A fifth aspect of the present invention is a lighting fixture including the electronic ballast according to any one of the first to fourth aspects of the present invention.

According to the first and second aspects of the present invention, a power loss without contributing to a light output due to a constant preheating current flowing into filaments serving as a current path can be reduced in a lighting mode with a large light output in which an appropriate filament temperature can be maintained by a lamp current. An appropriate filament temperature can be maintained by securing the constant preheating current flowing into the filaments serving as a current path in a lighting mode with a small light output in which an appropriate filament temperature cannot be maintained only by a lamp current, so that problems related to premature filament failure (i.e. short life of lamp) can be prevented.

According to the third aspect of the present invention, power consumption can be efficiently converted into a light output and filament overheating can also be prevented in a first lighting mode. This prevents blackening of the lamp bulb, premature filament failure, and premature emitter exhaustion. Meanwhile, in a second lighting mode to obtain power saving and lighting effects by suppressing power consumed in a lamp, these effects can be obtained while preventing premature blackening of the lamp bulb, filament failure, and emitter exhaustion.

According to the fourth aspect of the present invention, it is possible to establish any amount of a filament current in accordance with the degree of a dimming control for a lamp without requiring an operation performed for a constant preheating current by a resonance effect, thereby making it easier to design a circuit for supplying preheating power.

DETAILED DESCRIPTION OF THE INVENTION

Figure 1:
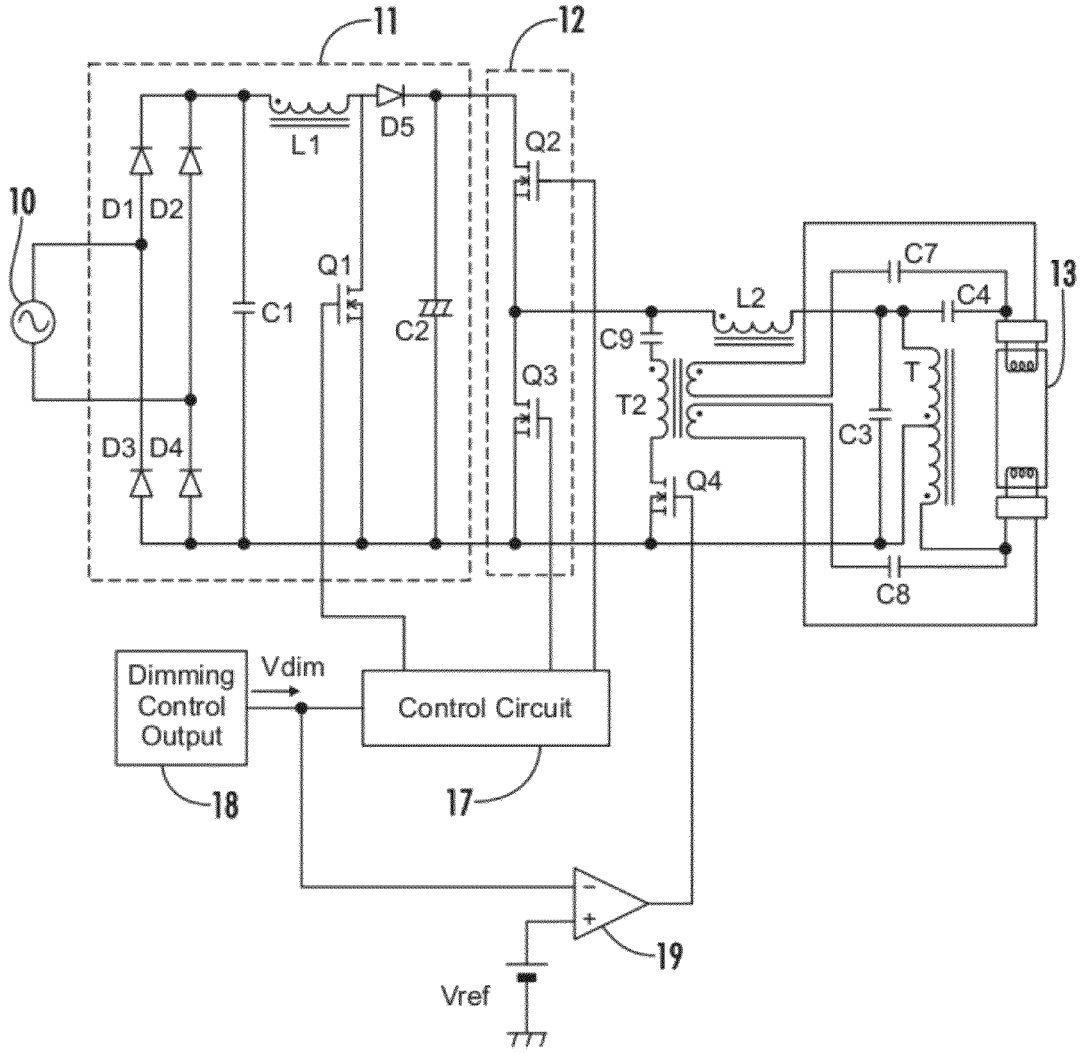
FIG. 1 is a circuit diagram showing a first embodiment of the present invention.

Shown in FIG. 1 is a circuit configuration of an electronic ballast according to a first embodiment of the invention to explain the configuration and operation thereof.

In this embodiment, an AC voltage of 100V and 50/60 Hz supplied from a commercial power source 10 is rectified to a DC voltage with a peak value of about 141V by a diode bridge including diodes D1 to D4. The DC voltage is stepped up by a step-up chopper circuit including a choke coil L1, a transistor Q1 and a diode D5. Obtained at both ends of an electrolytic capacitor C2 connected to an output end of the step-up chopper circuit is a DC voltage of, for example, about 300V. This DC voltage is converted into high frequency power in a subsequent inverter 12 and used as lighting power for a discharge lamp 13.

The inverter 12 has a half bridge inverter circuit including serially connected transistors Q2 and Q3, and provides a high frequency rectangular wave voltage at a connection point between the switching transistors Q2 and Q3, by a control circuit 17 which carries out a high frequency switching operation to turn on the transistors Q2 and Q3 alternately. The high frequency voltage is converted into lighting power of a substantially sinusoidal wave by a resonance action of an inductor L2 and a capacitor C3. This lighting power is supplied to the discharge lamp 13 via a step-up transformer T and a DC blocking capacitor C4. The discharge lamp 13 which is a thermionic cathode fluorescent lamp is connected to the lighting device via a lamp socket.

The control circuit 17 may include an integrated circuit (or other components) to control a lighting output of the discharge lamp 13 to a predetermined output by driving the transistor Q1 in step-up chopper circuit 11 and the transistors Q2 and Q3 in the inverter 12 in response to signals for turning on/off and dimming control or other signals sent from a dimming control output circuit 18 such as a remote control signal receiving device.

High frequency power outputted from the inverter circuit 12 is also made to flow into a transformer T2 through a capacitor C9. Power induced to a secondary side of the transformer T2 causes a current to flow into filaments of the discharge lamp 13 through capacitors C7 and C8. Also connected in series to the capacitor C9 and the transformer T2 is a transistor Q4 whose switching operation is used to switch an amount of current supplied to the filaments. The transistors Q1 to Q4 may be MOSFETs or other semiconductor switching elements.

A driving signal for the transistor Q4 is supplied from an output terminal of a comparator 19 which has a positive input terminal for inputting a fixed voltage Vref and a negative input terminal for inputting a dimming control level signal Vdim from the dimming control output circuit 18 to the control circuit circuit 17.

The dimming control level signal Vdim corresponds to a smoothed DC voltage which is increased as a light output is controlled to be higher and is decreased as a light output is reduced by a dimming control. If it is assumed that a dimming control level signal obtained in a maximum light output is Vdim1 and a dimming control level signal obtained in a minimum light output is Vdim2, a relationship therebetween relative to the fixed voltage Vref will be Vdim2<Vref<Vdim1.

More specifically, the transistor Q4 is turned off to stop supplying a constant preheating current in a lighting mode with a dimming control level equal to or greater than nominal or rated brightness. Here, if an impedance element such as a capacitor is connected in series with the transistor Q4, supplying a constant preheating current can be suppressed by turning off the transistor Q4. On the contrary, in a lighting mode with a dimming control level equal to or less than rated or nominal brightness, the transistor Q4 is turned on to supply a constant preheating current.

Note that, in shifting the discharge lamp 13 from a turned-off state to a turned-on state by a lighting signal inputted upon power supply or from a remote control transmitter, the dimming control level signal Vdim is fixed to an "L" level during a preheating period prior to lamp lighting and the transistor Q4 is turned on to supply a preheating current.

Figure 2:
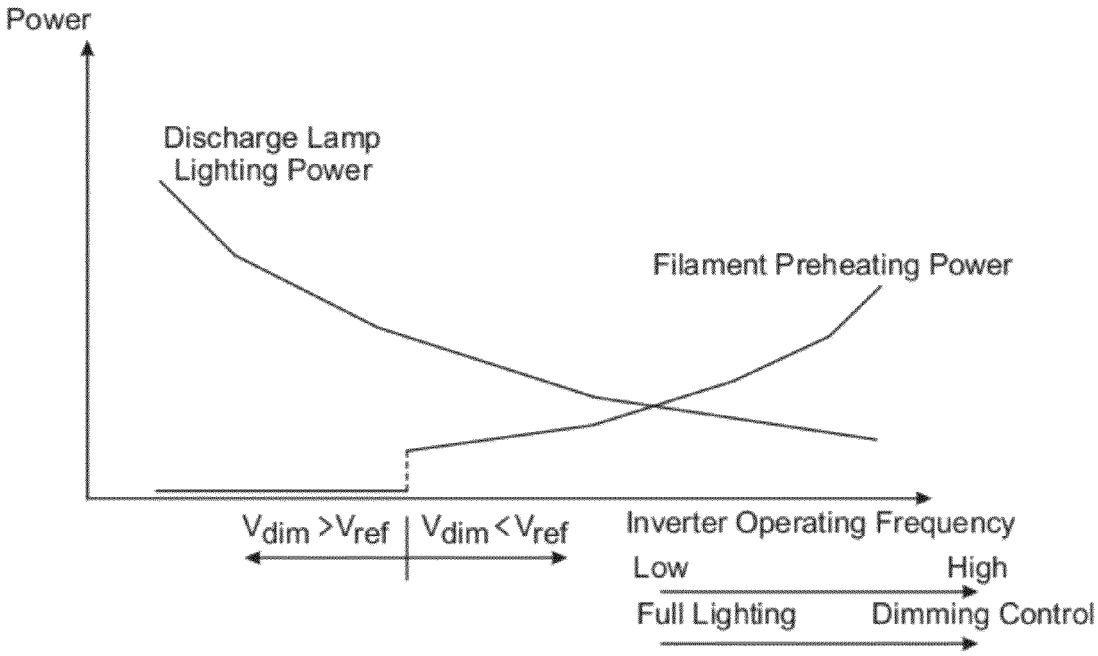
FIG. 2 is a graphical diagram showing transition of lighting power and preheating power according to the first embodiment of the present invention.
Figure 3:
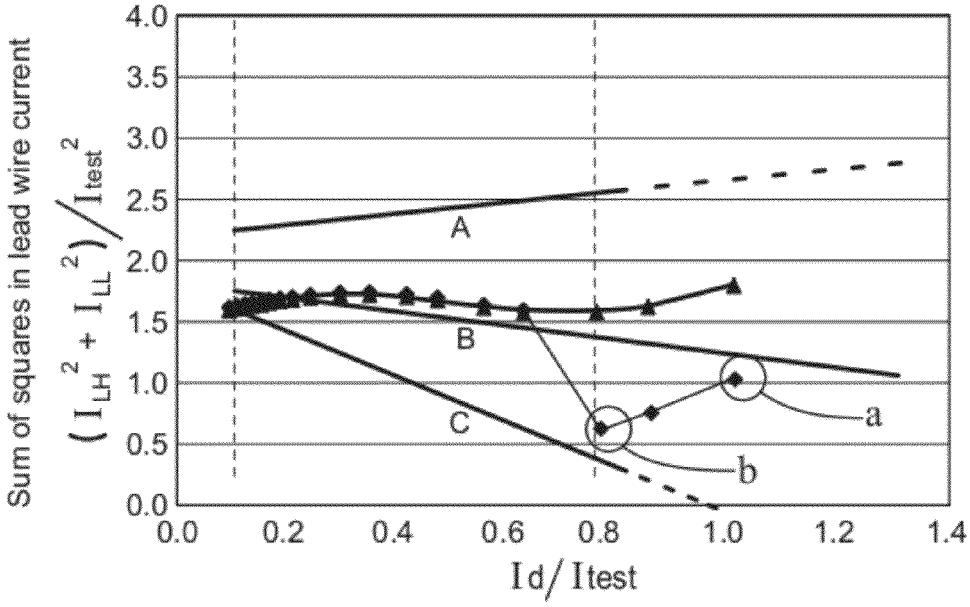
FIG. 3 is a dimming data sheet showing plotted data for a lighting state realized by a electronic ballast according to the first embodiment of the present invention.

FIG. 2 shows transition of lighting power in the discharge lamp and preheating power in the filaments in a dimming control operation during lighting. FIG. 3 also shows changes observed in a lamp current Id, a lead wire current $I_{LH}$, and a constant preheating current $I_{LL}$ as plotted data on the aforementioned dimming control data sheet. ▲ indicates a characteristic observed when the transistor Q4 is turned on and ♦ indicates a characteristic observed when the transistor Q4 is turned off.

In FIG. 3, a constant preheating current is substantially 0 [A] in a lighting state a with a maximum light output and operated at a point close to a target dimming control curve B.

In accordance with reduction of a light output, a preheating current undergoes a transition to a direction in which the preheating current becomes insufficient as shown in a lighting state b. The transistor Q4 is switched from a turned-off state to a turned-on state when a light output reaches a fixed point or less (i.e. less than 0.7 on the horizontal axis) and begins supplying a constant preheating current. This is followed by increasing the constant preheating current as a light output decreases thereafter and carrying out an operation at a point along a target dimming control curve B on the dimming control data sheet. That is, an appropriate filament temperature is maintained during lighting.

An electronic ballast according to a second embodiment of the present invention will be explained. It has basically a same circuit configuration as the first embodiment (i.e. circuit shown in FIG. 1) and there is a difference only in that an LED not shown is added as a night-light to the aforementioned control circuit circuit 17. The discharge lamp 13 here is also a thermionic cathode fluorescent lamp.

The fluorescent lamp has lighting modes including a first lighting mode (i.e. full-lighting mode) with a large light output, and a second lighting mode (i.e. dimming control mode), allowing an operation over a plurality of stages with a light output smaller than that of the first lighting mode.

Figure 4:
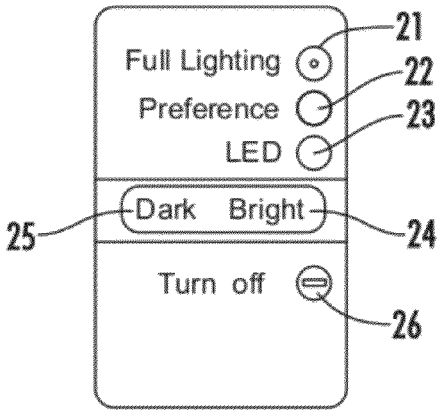
FIG. 4 is a front view showing an appearance of a remote control transmitter for use in a second embodiment of the present invention.

FIG. 4 shows an appearance of an infrared remote control signal transmitter for use in operating the electronic ballast according to the present embodiment. Arranged in a transmitter 20 are a full-lighting button 21 for controlling to the first lighting mode (full-lighting mode), a preference button 22 for switching to the second lighting mode (i.e. dimming control mode), an LED button 23 for turning on the LED night light by turning off a fluorescent lamp, a brightness button 24 and a darkness button 25 for operating a lighting output over a plurality of dimming stages in the second lighting mode (i.e. dimming control mode) or the LED lighting mode, and a turn-off button 26 for turning off both a fluorescent lamp and the LED to bring the lighting fixture into a standby mode.

If the full-lighting button 21 is pressed in the transmitter 20 to realize the first lighting mode (i.e. full-lighting mode), the transistor Q4 arranged in the preheating resonant circuit is turned off to bring a constant preheating current into substantially 0 [A].

If the preference button 22 is pressed in the transmitter 20 to realize the second lighting mode (i.e. dimming control mode), the transistor Q4 arranged in the preheating resonance circuit is turned on to supply the constant preheating current.

Figure 5:
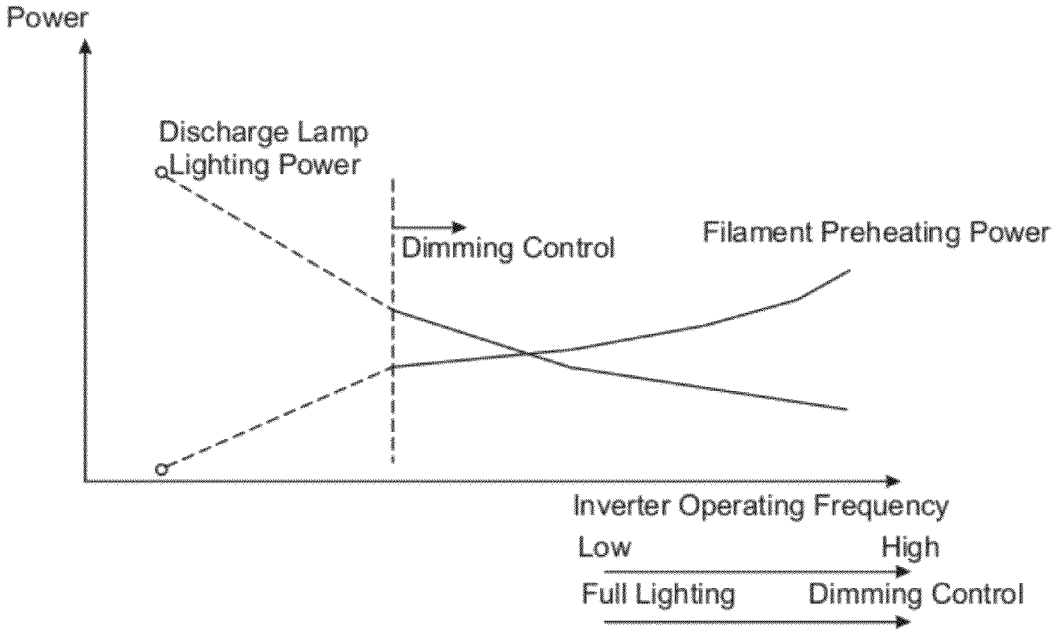
FIG. 5 is a graphical diagram showing transition of lighting power and preheating power according to the second embodiment of the present invention.
Figure 6:
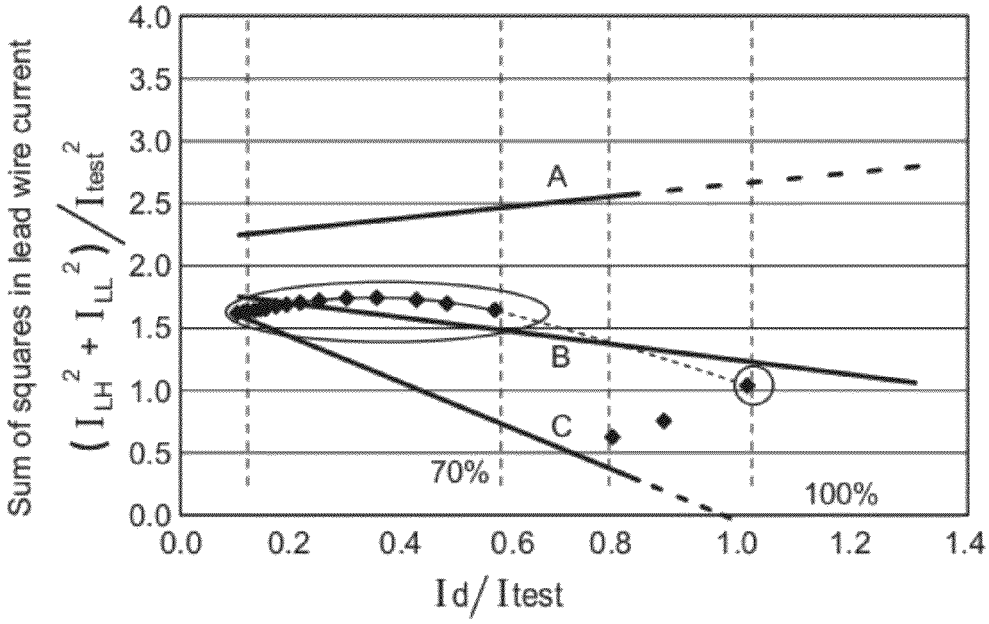
FIG. 6 is a dimming data sheet showing plotted data for a lighting state realized by a electronic ballast according to the second embodiment of the present invention.

FIG. 5 shows transition of lighting power in a discharge lamp and preheating power in filaments in a dimming control operation during lighting. FIG. 6 also shows changes observed at this time in the lamp current Id, the lead wire current $I_{LH}$ and the constant preheating current $I_{LL}$ as plotted data on the aforementioned dimming control data sheet.

In FIG. 6, a constant preheating current is substantially 0 [A] and disposed adjacent to the target dimming control curve B in a lighting state of the first lighting mode (i.e. full-lighting mode).

In the second lighting mode (i.e. dimming control mode), the constant preheating current is supplied to increase the constant preheating current as a light output is decreased thereafter, followed by an operation at a point along the target dimming control curve B on the dimming control data sheet. That is, an appropriate filament temperature can be maintained during lighting.

In the case of carrying out a feedback control for a lamp light output by power consumed in the inverter, power required for constant preheating is also combined for feedback, wherein there is a danger that a discontinuous change may happen in switching to a constant preheating current in the middle of continuously reducing a light output as shown in the first embodiment (refer to FIG. 3). Such visual discontinuity can be prevented by creating a sufficient difference in the light output using the first lighting mode (i.e. full-lighting mode) and the second lighting mode (i.e. dimming control mode) as shown in FIG. 6.

An unexpected operation may also happen in response to a power saving operation by a user in the first embodiment such that a light output is slightly reduced due to decreased discharge lamp lighting power before and after switching the transistor Q4 from a turned-off state to a turned-on state. As understood from FIG. 2 while power consumption in the ballast as a whole is almost free from any changes resulting from increased filament preheating power, the present embodiment creates a sufficient difference in the light output by using the first lighting mode (i.e. full-lighting mode) and the second lighting mode (i.e. dimming control mode) so as to realize a remarkable reduction in the discharge lamp lighting power in comparison with an increase in the filament preheating power and obtains certain power saving effects by selecting the second lighting mode (i.e. dimming control mode), so that an unexpected operation in response to a power saving operation by a user can be prevented.

Figure 7:
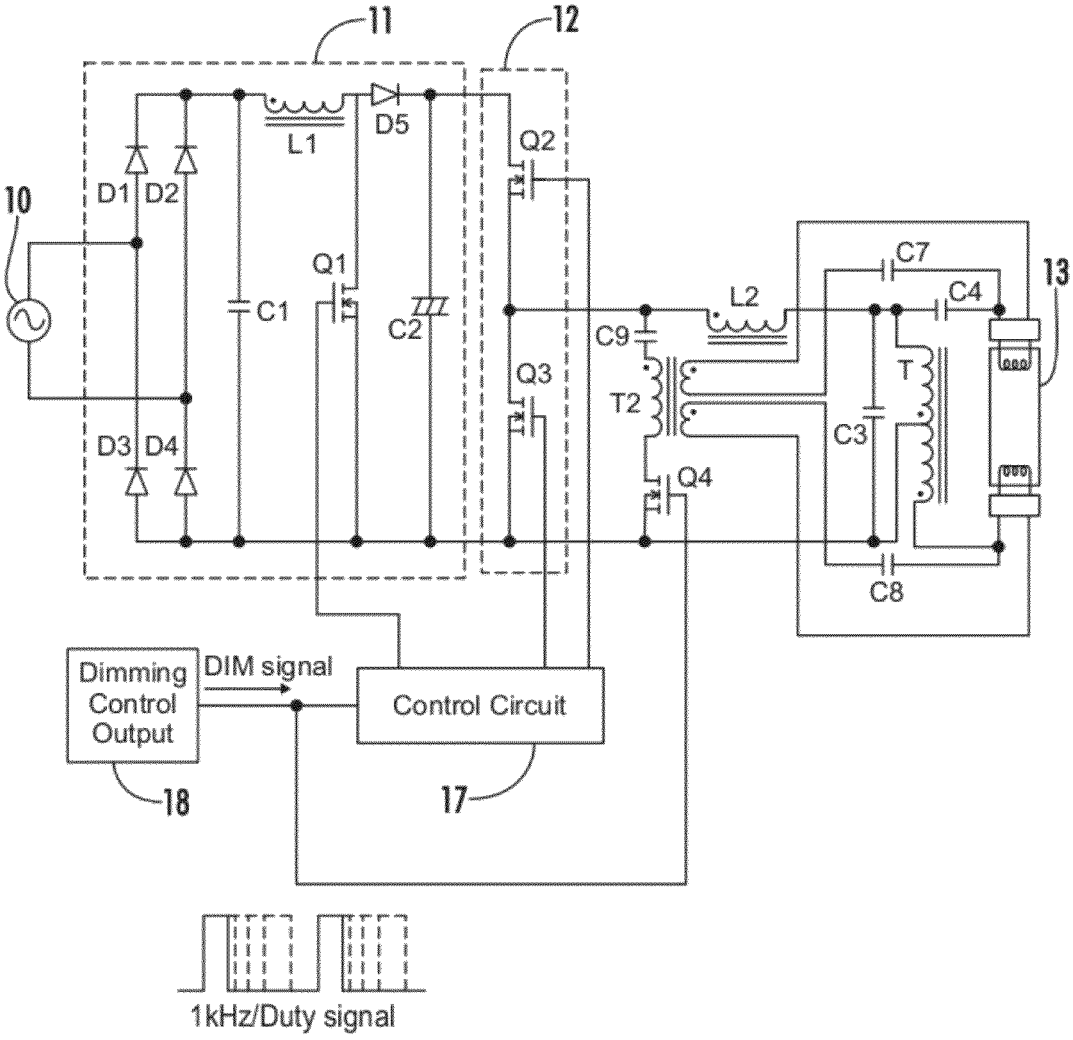
FIG. 7 is a circuit diagram according to a third embodiment of the present invention.

An electronic ballast according to a third embodiment of the present invention will be explained with reference to FIG. 7. Since the present embodiment has a basic circuit operation in common with the first embodiment, explanation thereof will be omitted here.

The preheating resonant circuit does not have a resonance effect to increase a constant preheating current as light output decreases as shown in the first and second embodiments. Also, the capacitor C9 has a sufficiently large capacitance so that a resonance frequency calculated for the preheating resonant circuit is much smaller than an operating frequency in the inverter. A constant preheating current is obtained when the transistor Q4 is turned on and is characterized as being substantially flat relative to a change in a light output, that is an oscillation frequency.

Meanwhile, inputted from the dimming control output circuit 18 (such as a remote control signal receiving circuit) to the control circuit 17 is a DIM signal which determines a dimming control level. The DIM signal is a duty cycle signal with a frequency of 1 kHz, having an ON time which is made larger in accordance with a smaller light output. In order to realize a dimming control level corresponding to this signal, the light output is controlled by the control circuit 17. The DIM signal is further used to drive the transistor Q4 to be turned on/off.

Therefore, an appropriate filament temperature can be maintained in accordance with each lamp output mode by carrying out an operation to increase/decrease an amount of time to supply a constant preheating current, which is characterized as being flat by nature as stated above, in response to a lighting control signal.

Moreover, in the case where light outputted from a lamp is subjected to a feedback control by power consumed in the inverter, power required for constant preheating is also combined for feedback, so that there is a danger that a discontinuous change may happen in switching to a constant preheating current in the middle of reducing a light output continuously. Such a visual sense of incompatibility can be eliminated by applying stepwise changes to an effective value of the constant preheating current in the same manner with the light output.

Note that the transistor Q4 is controlled to be turned on/off in the present embodiment by using a duty cycle signal (of 1 kHz) for dimming control without making any changes, but it may be replaced with a control to turn on/off the transistor Q4 by an output of a PWM control circuit which is arranged to convert the dimming control level signal Vdim made of a smoothed DC voltage as shown in FIG. 1 into a duty cycle signal with variable ON time. For example, if the fixed voltage Vref inputted to a positive input terminal of the comparator 19 is replaced with a triangular wave oscillator for carrying out oscillation with an amplitude including the aforementioned Vdim2 to Vdim1 and/or an oscillator with any waveforms in the circuit configuration shown in FIG. 1, it is possible to realize a control so that the transistor Q4 has short ON time in a large light output and long ON time in a small light output. A switching period in the transistor Q4 may be set by taking a thermal time constant in the filaments or other factors into consideration.

Figure 8:
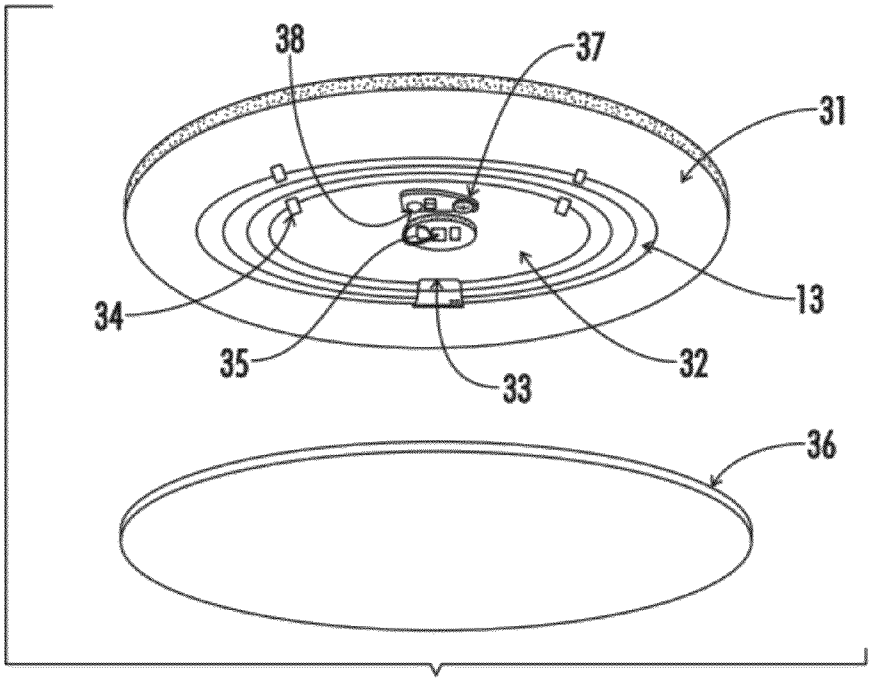
FIG. 8 is an exploded perspective view showing a schematic configuration of a lighting fixture according to a fourth aspect of the present invention.
Figure 9:
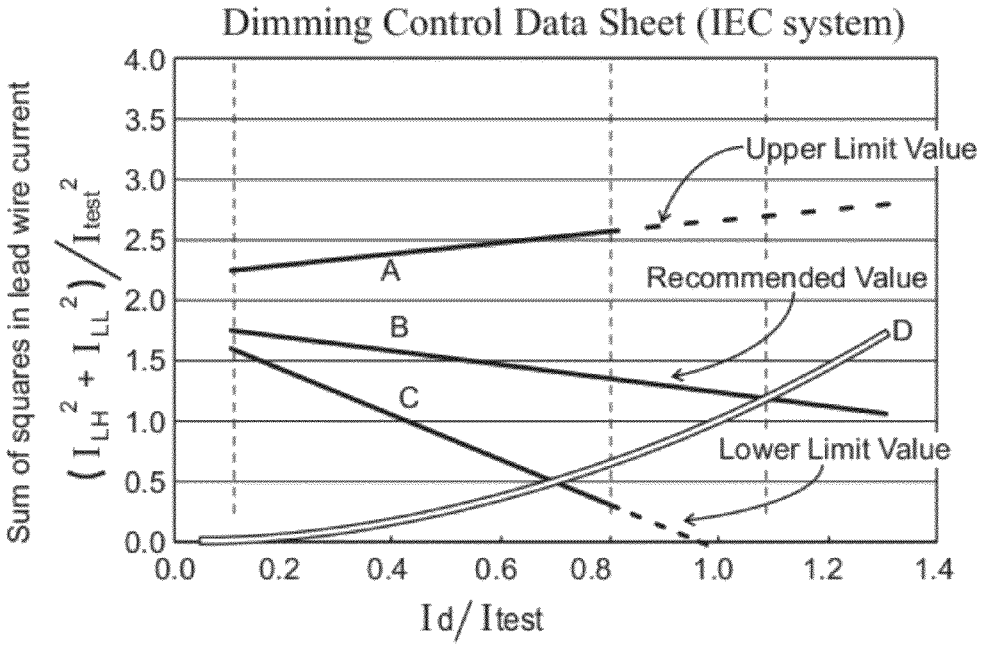
FIG. 9 is a characteristic diagram showing one example of a general dimming control data sheet.
Figure 10:
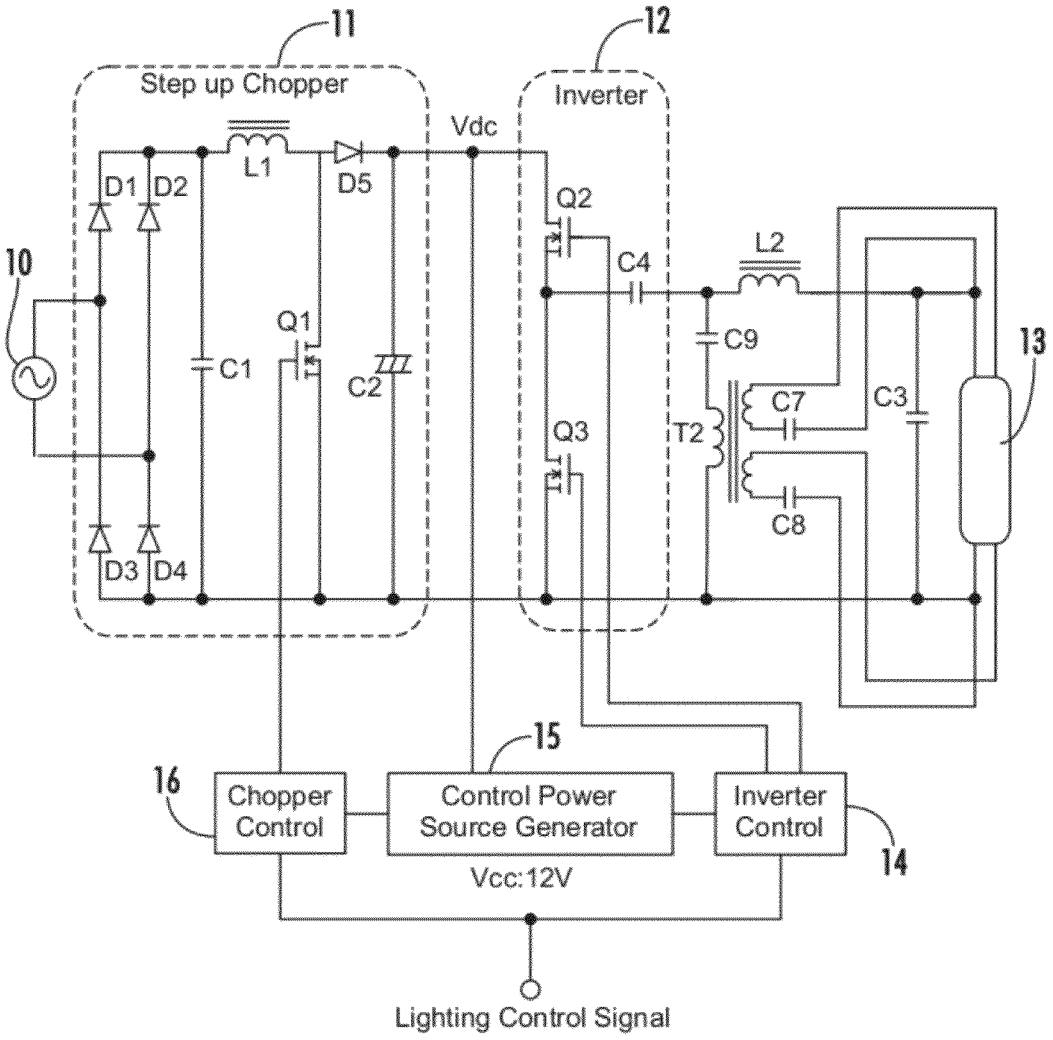
FIG. 10 (PRIOR ART)
FIG. 10 is a circuit diagram showing a electronic ballast according to a first conventional example.
Figure 11:
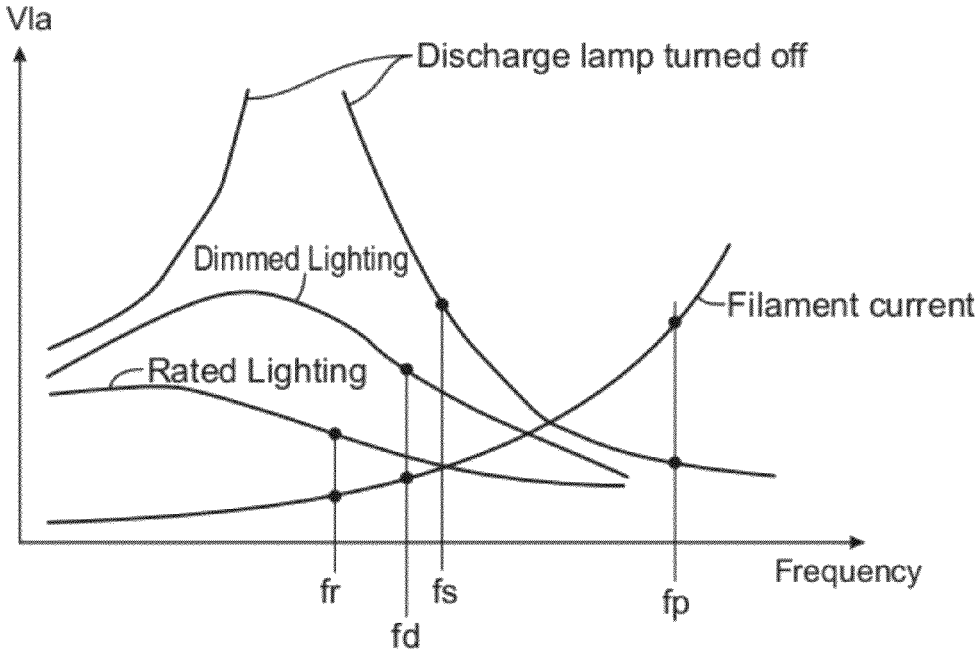
FIG. 11 (PRIOR ART)
FIG. 11 is a characteristic diagram showing transition of a lighting output/preheating output in the electronic ballast according to the first conventional example.
Figure 12:
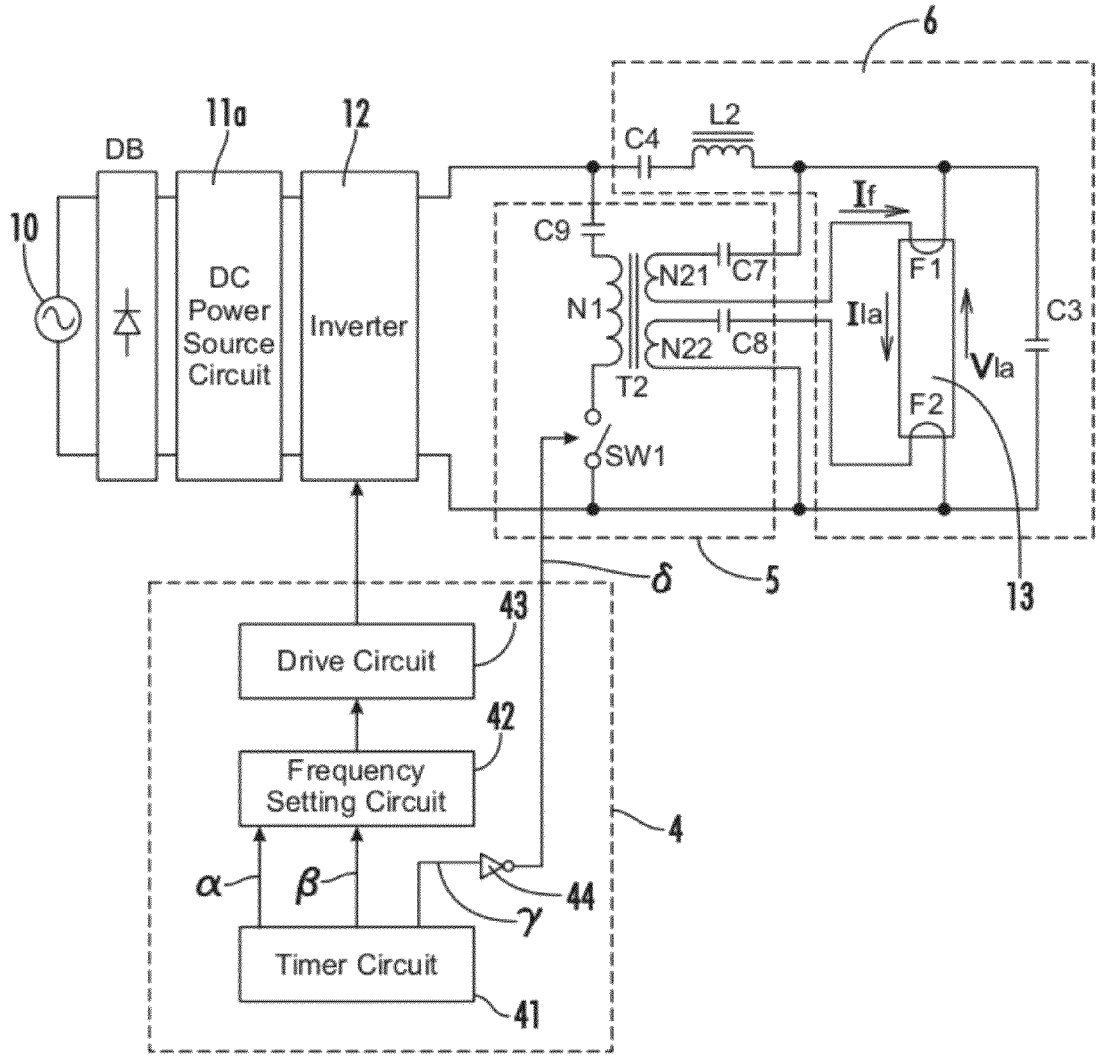
FIG. 12 (PRIOR ART)
FIG. 12 is a circuit diagram showing a electronic ballast according to a second conventional example.
Figure 13:
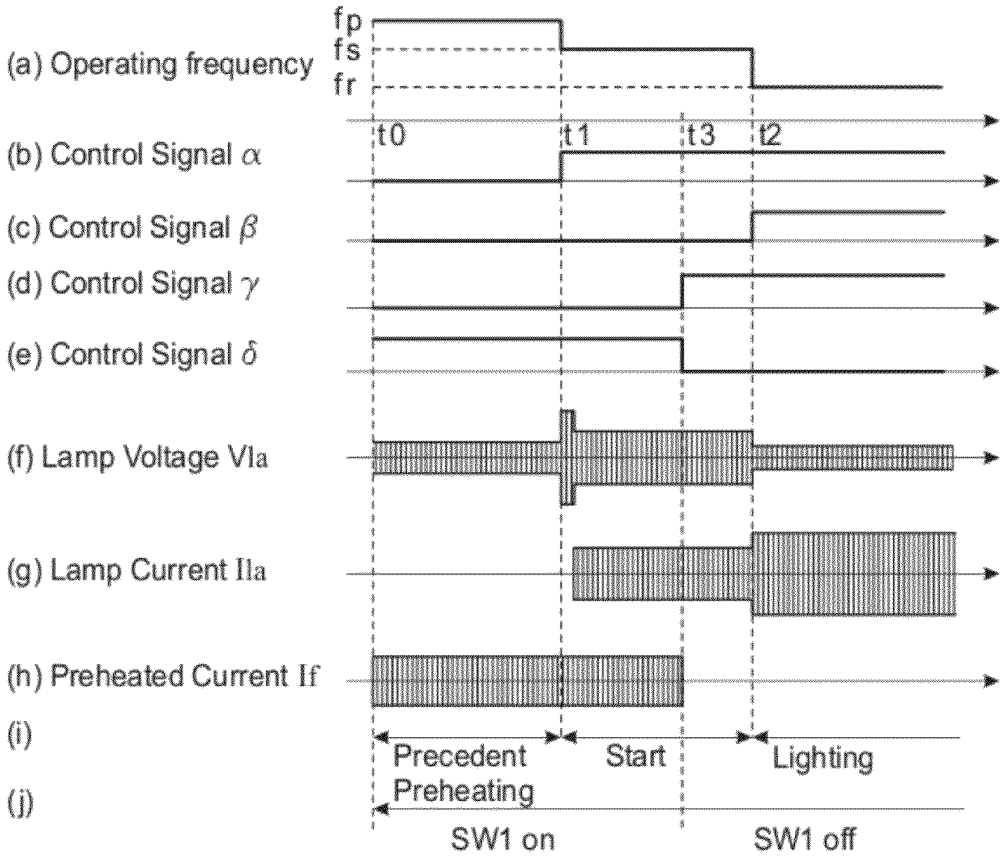
FIG. 13 (PRIOR ART)
FIG. 13 is a timing chart showing how to control the electronic ballast according to the second conventional example at the time of starting.

FIG. 8 shows an appearance of a lighting fixture using the electronic ballast according to any one of the aforementioned first to third embodiments. The lighting fixture shown in FIG.

8 is a ceiling light directly attached to a ceiling, including a lighting fixture main body 31 incorporating the electronic ballast, a ring fluorescent lamp 13 serving as a light source, a reflector plate 32 for reflecting light of the fluorescent lamp 13, a lamp socket 33 for fixing the fluorescent lamp 13 to the lighting fixture main body 31 and supplying lighting power from the electronic ballast to the fluorescent lamp 13, a lamp supporting spring 34 for fixing the fluorescent lamp 13 to the lighting fixture main body 31, a power supply mechanism 35 for fixing the lighting fixture main body 31 to a ceiling surface and supplying a commercial power source to the electronic ballast, a light transmitting cover 36 attached to the lighting fixture main body 31 so as to disperse light from the fluorescent lamp, a receiving device 37 for controlling the electronic ballast by receiving an infrared signal from the remote control transmitter from the outside of the fixture, and an LED 38 arranged on the receiving device 37 and used for the purpose of a night-light.

Thus, although there have been described particular embodiments of the present invention of a new and useful electronic ballast with preheat current control, it is not intended that such references be construed as limitations upon the scope of this invention except as set forth in the following claims.

What is claimed is:

1. An electronic ballast for high frequency lighting of a discharge lamp having lamp filaments and operating in a preheating mode, a starting mode, a first lighting mode, and a second lighting mode, the electronic ballast comprising:

an inverter;

a main resonant circuit coupled to the inverter; and a preheating circuit having a winding component connected in parallel with the main resonant circuit, the winding component comprising a primary winding and a secondary winding, and a switch connected in series with the primary winding;

wherein a path of a current flowing in the primary winding of the winding component is switched ON by the switch in the first lighting mode and OFF in the second lighting mode, wherein the first lighting mode has a rated lamp output and the second lighting mode has a dimmed lamp output, wherein a constant preheating current for filaments in the lamp is supplied from the secondary winding of the winding component during the preheating mode, the starting mode, and the second lighting mode of the discharge lamp.

2. The electronic ballast according to claim 1, wherein the preheating circuit comprises a preheating resonant circuit including the primary winding of the winding component and a serially connected capacitance; and an oscillation frequency in the electronic ballast during lighting is operated to be higher than a resonant frequency in the main resonant circuit with a lamp current flowing therein and lower than a resonant frequency in the preheating resonant circuit.

3. The electronic ballast according to claim 1, wherein the ballast further comprises:

a switch control circuit;

wherein in the first lighting mode, the switch control circuit causes the preheating circuit to disable the constant preheating current for the lamp filaments by turning off the switch arranged in the current path; and wherein in the second lighting mode, the switch control circuit causes the preheating circuit to supply the constant preheating current for the lamp filaments by turning on the switch arranged in the current path.

4. The electronic ballast according to claim 3, further comprising a comparator coupled between the switch control circuit and the switch, wherein the comparator causes the preheating circuit to disable the constant preheating current for the lamp filaments by turning off the switch arranged in the current path when a voltage output from the switch control circuit exceeds a reference voltage further coupled to the comparator, and wherein the comparator causes the preheating circuit to supply the constant preheating current for the lamp filaments by turning on the switch arranged in the current path when a voltage output from the switch control circuit is lower than a reference voltage further coupled to the comparator.

5. The electronic ballast according to claim 4, wherein the filament preheating power increases in accordance with a decrease in the discharge lamp lighting power.

6. An electronic ballast for powering a discharge lamp in a preheating mode, a starting mode, and a plurality of lighting modes, the ballast comprising:

an inverter;

a main resonant circuit coupled to a positive output terminal of the inverter and further coupled across the discharge lamp;

a preheating circuit coupled in parallel with the main resonant circuit and comprising a primary winding of a transformer and a switching element coupled in series across the positive output terminal and a negative output terminal of the inverter, and further comprising a secondary winding of the transformer coupled across one or more filaments in the discharge lamp; and a dimming control circuit coupled to the switching element and configured to provide a pulse width modulated signal to turn on and off the switching element with an ON time which increases and decreases in accordance with an output power from the inverter to the lamp during the plurality of lighting modes of the ballast.

7. The ballast of claim 6, wherein an oscillation frequency in the inverter associated with a nominal power output to the discharge lamp is configured to be higher than a resonant frequency in the main resonant circuit and lower than a resonant frequency in the preheating circuit.

8. The ballast of claim 7, wherein the preheating circuit comprises a large value capacitor coupled between the positive output terminal of the inverter and the primary winding of the transformer, wherein the resonant frequency in the preheating circuit is much smaller than a nominal operating frequency for the inverter and wherein a constant preheating current produced when the switching element is turned on is substantially flat relative to a change in the oscillation frequency of the inverter.

9. The ballast of claim 6, wherein the on time for the switching element is increased in association with a decrease in the output power provided across the lamp, and the on time for the switching element is decreased in association with an increase in the output power provided across the lamp.

10. The ballast of claim 9, wherein the on time for the switching element is determined in accordance with the output power provided across the lamp and a thermal time constant associated with the one or more lamp filaments.

11. A lighting assembly for powering a fluorescent lamp, the lighting assembly comprising:

a lighting fixture comprising an electronic ballast and a lamp socket configured to receive the lamp, the electronic ballast further comprising:

an inverter comprising a plurality of inverter switches, a first resonant circuit coupled to a positive output terminal of the inverter, the first resonant circuit having an output power provided across the lamp, a second resonant circuit coupled to the positive output terminal of the inverter in parallel with the first resonant circuit and comprising a switch, the second resonant circuit having an output power provided across one or more filaments at either end of the lamp, and a switch control circuit configured to turn on and off the inverter switches in the inverter and the switch in the second resonant circuit, wherein the switch is turned on to enable a constant preheating current across one or more lamp filaments during a preheating mode and a starting mode;

a receiving device effective to receive remote control signals and transmit said control signals to the switch control circuit; and a remote control signal transmitter configured to provide the remote control signals to the receiving device in association with:

a first lighting mode having a first light output of the lamp, wherein the switch in the second resonant circuit is turned off to disable a constant preheating current across one or more lamp filaments, and a second lighting mode having a second light output less than the first light output, wherein the switch in the second resonant circuit is turned on to enable a constant preheating current across one or more lamp filaments.

12. The lighting assembly of claim 11, further comprising an LED arranged on the receiving device, wherein the LED is driven to emit light when the fluorescent lamp is turned off.

13. The lighting assembly of claim 12, the remote control signal transmitter further configured to provide a remote control signal to the receiving device in association with a standby mode, wherein both of the fluorescent lamp and the LED are turned off.

14. The lighting assembly of claim 11, the remote control signal transmitter further configured to provide a plurality of remote control signals to the receiving device in association with a plurality of dimming stages in the second lighting mode, wherein the switch in the second resonant circuit is turned on and off with an on time associated with the selected dimming stage.

15. The lighting assembly of claim 14, wherein the on time for the switch is increased in association with a decrease in the output power provided across the lamp by the first resonant circuit, and the on time for the switch is decreased in association with an increase in the output power provided across the lamp.

16. The lighting assembly of claim 11, wherein a driving frequency in the inverter associated with a nominal power output to the lamp is configured to be higher than a resonant frequency in the first resonant circuit and lower than a resonant frequency in the second resonant circuit.

17. The lighting assembly of claim 16, further comprising:

the second resonant circuit comprises a large value capacitor coupled between the positive output terminal of the inverter and the primary winding of the transformer;

the resonant frequency in the second resonant circuit is much lower than a nominal operating frequency for the inverter; and a constant preheating current produced when the switching element is turned on is substantially flat relative to a change in the oscillation frequency of the inverter.

18. The lighting fixture of claim 11, further comprising a comparator coupled between the switch control circuit and the switch.

19. The lighting fixture of claim 18, wherein a comparator output provided to the switch is effective to disable power across the one or more lamp filaments by turning off the switch when an output from the switch control circuit exceeds a reference voltage further coupled to the comparator.

20. The lighting fixture of claim 19, wherein the comparator output provided to the switch is effective to supply power across the one or more lamp filaments by turning on the switch when an output from the switch control circuit is lower than the reference voltage.

* * * * *